US007445571B2

(12) United States Patent
Winningham

(10) Patent No.: US 7,445,571 B2
(45) Date of Patent: Nov. 4, 2008

(54) NET SHAPER

(75) Inventor: Matthew Winningham, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 297 days.

(21) Appl. No.: 11/439,708

(22) Filed: May 24, 2006

(65) Prior Publication Data

US 2006/0270495 A1 Nov. 30, 2006

Related U.S. Application Data

(60) Provisional application No. 60/685,136, filed on May 24, 2005.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS 1,437,378 A * 11/1922 Westcott ..... 473/554
1,612,109 A * 12/1926 Isaac ..... 473/554
2,060,619 A * 11/1936 Jacobson ..... 446/157
5,265,871 A 11/1993 Hanley
5,421,493 A 6/1995 Ebeling, II
5,425,541 A 6/1995 Ambros
5,638,999 A 6/1997 Greene
6,006,962 A 12/1999 Ebeling, II
6,138,879 A 10/2000 Breuner
7,244,200 B2 7/2007 Goldberg

OTHER PUBLICATIONS

Warrior 2000 Equipment Catalog, 2 pages.

* cited by examiner

*Primary Examiner*—Gene Kim
*Assistant Examiner*—M Chambers
(74) *Attorney, Agent, or Firm*—Warner Norcross & Judd LLP

(57) ABSTRACT

The present invention provides a net shaper for use with a lacrosse stick that specifically interacts with the net of the lacrosse stick to form a certain shape or contour of the net. The net shaper is a component having a generally nose-shaped profile that interacts with the net and at least two protrusions extending out from the component. The at least two protrusions interact with the frame and the net to maintain the position of the net shaper within the net of the lacrosse head.

14 Claims, 4 Drawing Sheets

NET SHAPER

CROSS-REFERENCE TO RELATED APPLICATIONS

The present invention claims priority from U.S. Provisional Application Ser. No. 60/685,136, filed May 24, 2005, and entitled "NET SHAPER."

FIELD OF THE INVENTION

The present invention generally relates to a device to aid in defining the shape of a lacrosse net attached to a lacrosse head. The present invention more particularly relates to a device that is placed within the net and remains in a desired position within the net when the lacrosse stick is not in use to assist in forming a pocket in the net.

BACKGROUND OF THE INVENTION

The lacrosse stick in general includes a handle that is attached to a head. The head includes a frame and a flexible net. The frame is rigid and defines a structural element to which the net is attached. The net is flexible and provides enough material to give the net depth beyond the frame to catch, cradle and maneuver a lacrosse ball. Although the net is flexible, it is preferred to have the net form a particular shape that is optimal for maneuvering the lacrosse ball. The optimal position for a net often varies from player to player.

Since lacrosse is a game that is frequently played outdoors, in all weather conditions, the net will frequently get wet. When wet, the net will lose its desired shape. Therefore, there is a need for a tool to aid in forming and maintaining a desired shape of the net.

It is known to use a lacrosse ball to aid in shaping the net. In one situation, the ball is placed within the wet net, at the deepest section to form the net to the ball's shape as it dries. However, a disadvantage is that the ball rolls out from the net and does not maintain a particular position within the net. It should be noted that the net can also be formed by placing a lacrosse ball within a dry net. However, the same disadvantage is encountered, the ball tends to roll out from the net. Therefore, there is a need for a component that will stay in a desired position within the net to form a desired shape of the net. Other net shaping devices exist, but they are not cumbersome and are smaller.

SUMMARY OF THE INVENTION

The present invention overcomes the disadvantages of known techniques for shaping a lacrosse net by providing a component that will aid in forming a desired shape of a lacrosse net and maintain a desired position within the lacrosse net. The net shaper of the present invention is easily locked into and out of a desired position within the net. The net shaper is locked within the lacrosse head when the lacrosse stick is not being used and is easily removed from the head when the stick is to be used.

The net shaper is a component having a generally nose-shaped profile and at least two protrusions for attaching the net shaper to the lacrosse head.

BRIEF DESCRIPTION OF THE DRAWINGS

The present invention will be described, by way of example, with reference to the following drawings.

DETAILED DESCRIPTION OF THE PREFERRED EMBODIMENT

Figure 1:
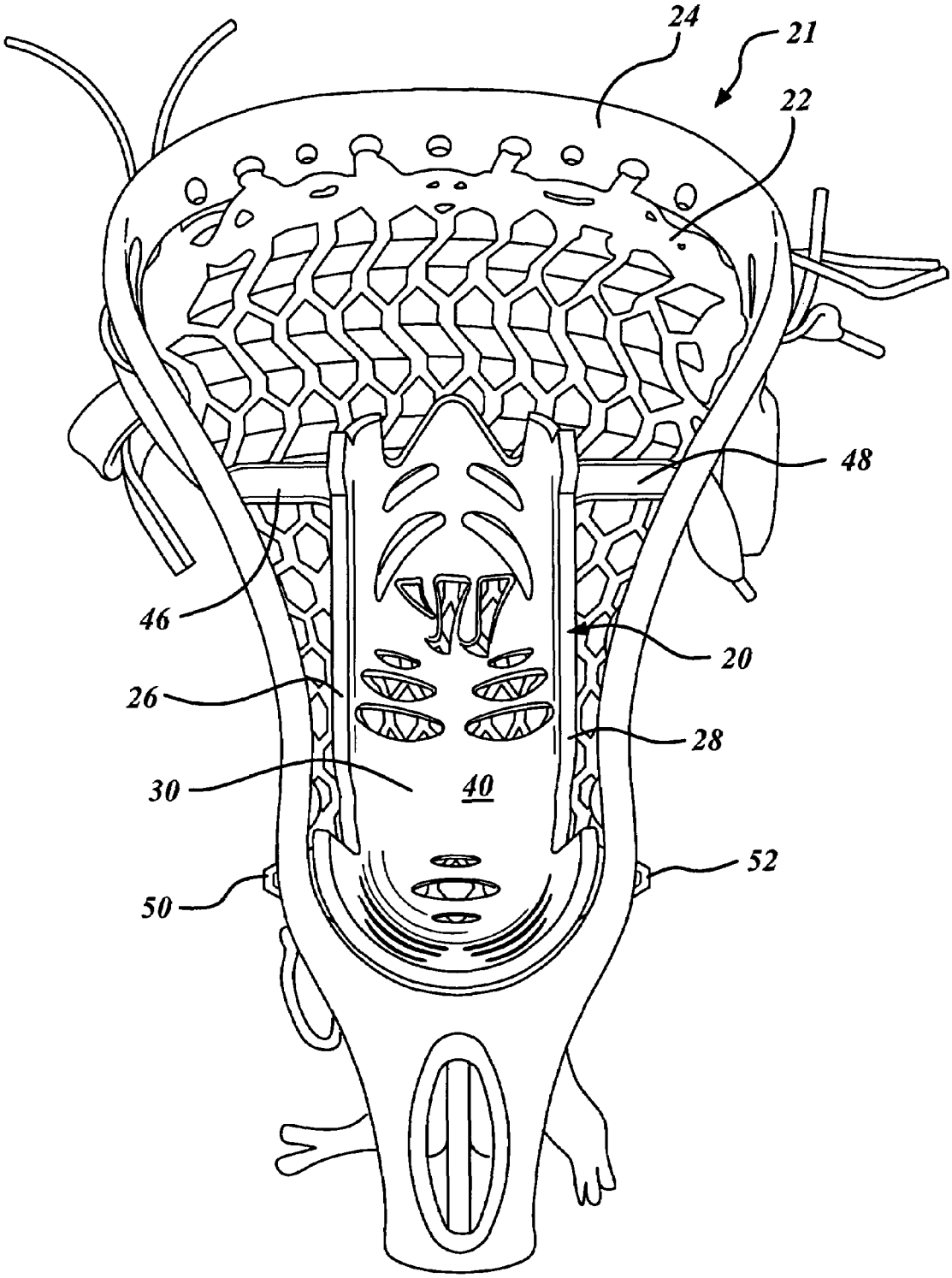
FIG. 1 illustrates a front view of one embodiment of the net shaper of the present invention positioned within a lacrosse head.
Figure 2:
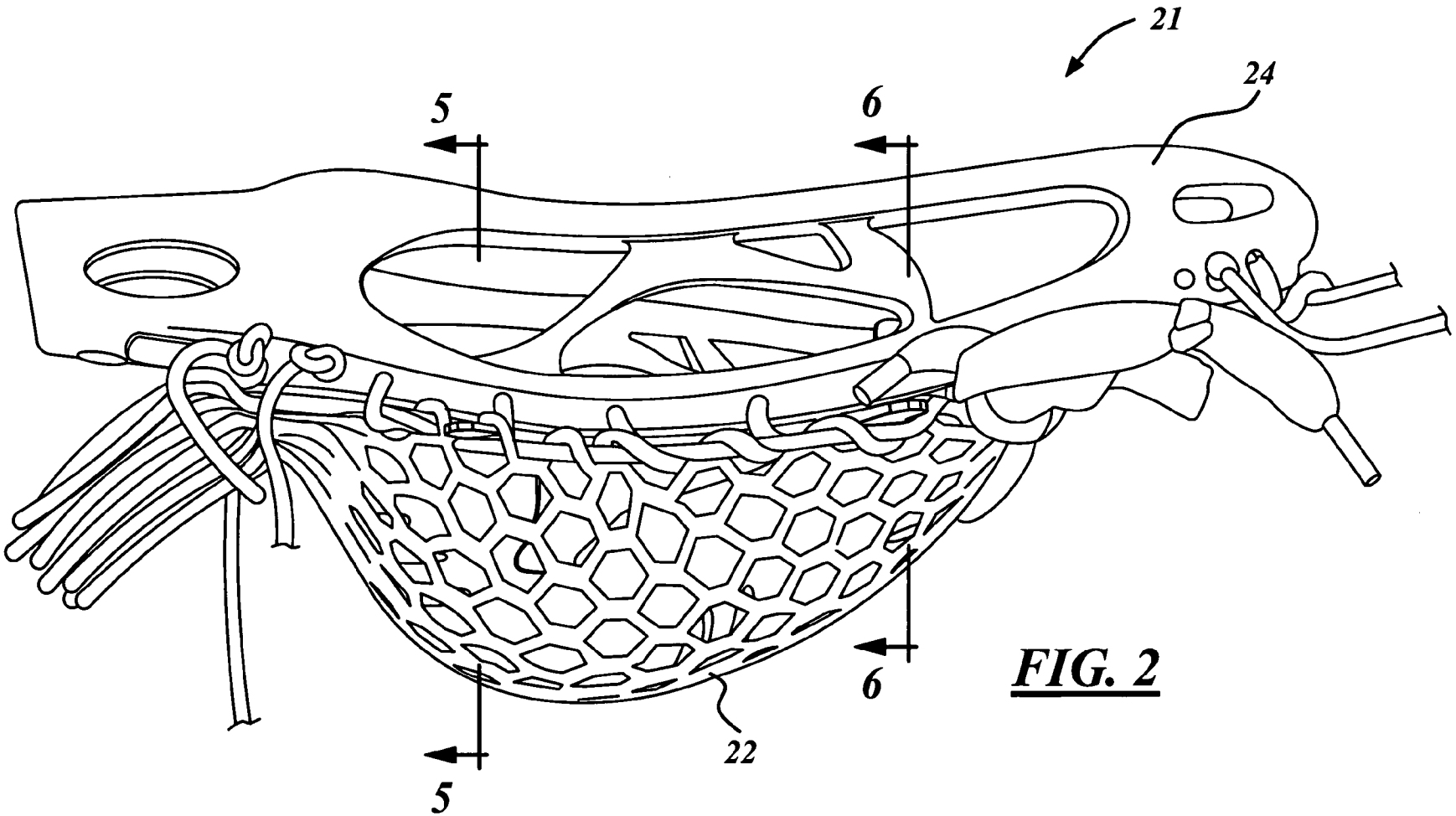
FIG. 2 illustrates a side view of one embodiment of the net shaper of the present invention positioned within a lacrosse head.

Referring to FIGS. 1 and 2, a net shaper, shown generally at 20, is disclosed in the present invention that is used in association with a lacrosse head, shown generally at 21. The lacrosse head 21 includes a net 22 that is attached to a lacrosse head frame 24. The lacrosse net 22 is flexible and includes enough material to give the net depth beyond the frame to cradle a lacrosse ball. The purpose of the net shaper 20 is to form a certain shape or contour of the net 22. The lacrosse ball is more easily maneuvered when the net 22 has formed a desired shape to cradle the ball. The net shaper 20 of the present invention aids in forming the desired shape of the net when used whether the net is wet or dry. Further, it is intended that the net shaper 20 will be removed from the lacrosse head prior to playing a game of lacrosse.

Figure 4:
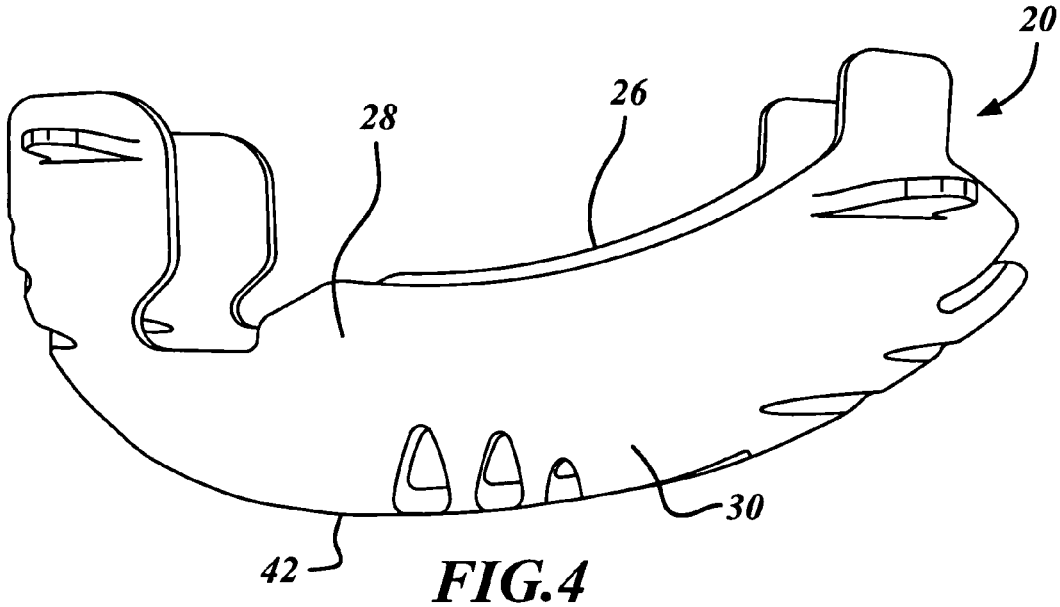
FIG. 4 illustrates a side view of one embodiment of the net shaper of the present invention.
Figure 5:
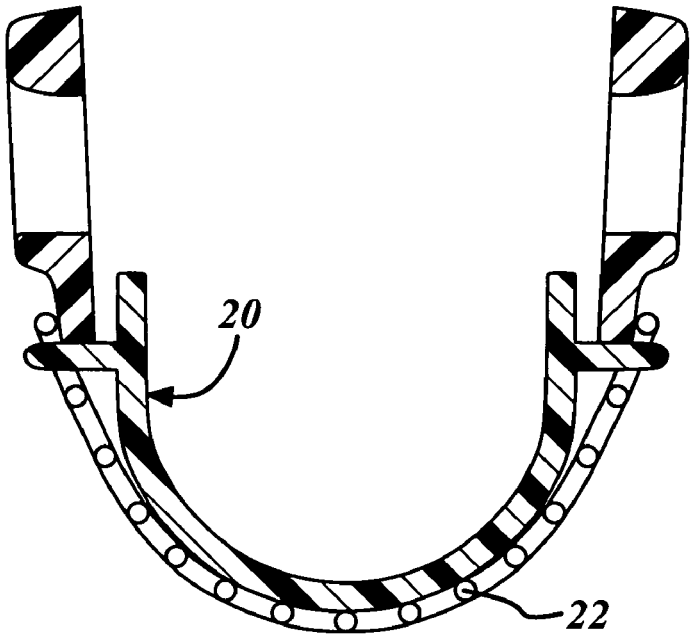
FIG. 5 illustrates a cut-away view taken along line 5-5 in FIG. 2.
Figure 6:
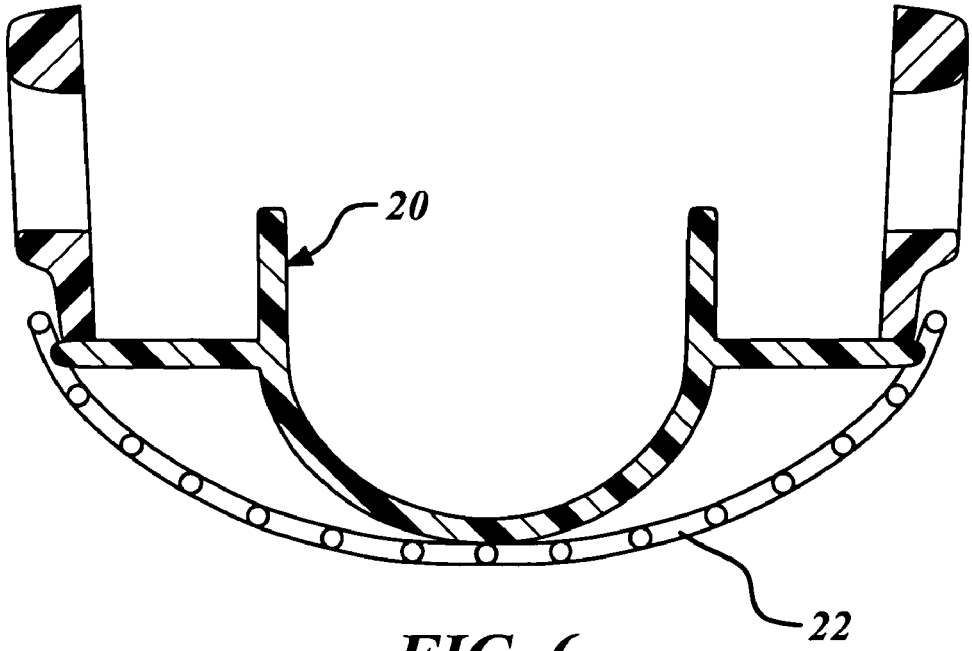
FIG. 6 illustrates a cut-away view taken along line 6-6 in FIG. 2.

In one embodiment, the net shaper 20 of the present invention is a single component having a generally nose-shaped profile, as illustrated in FIG. 4. It will be understood that the net shaper 20 may be formed of multiple components that are assembled. The net shaper 20 may be made from any number of materials, including, but not limited to a plastic.

Figure 3:
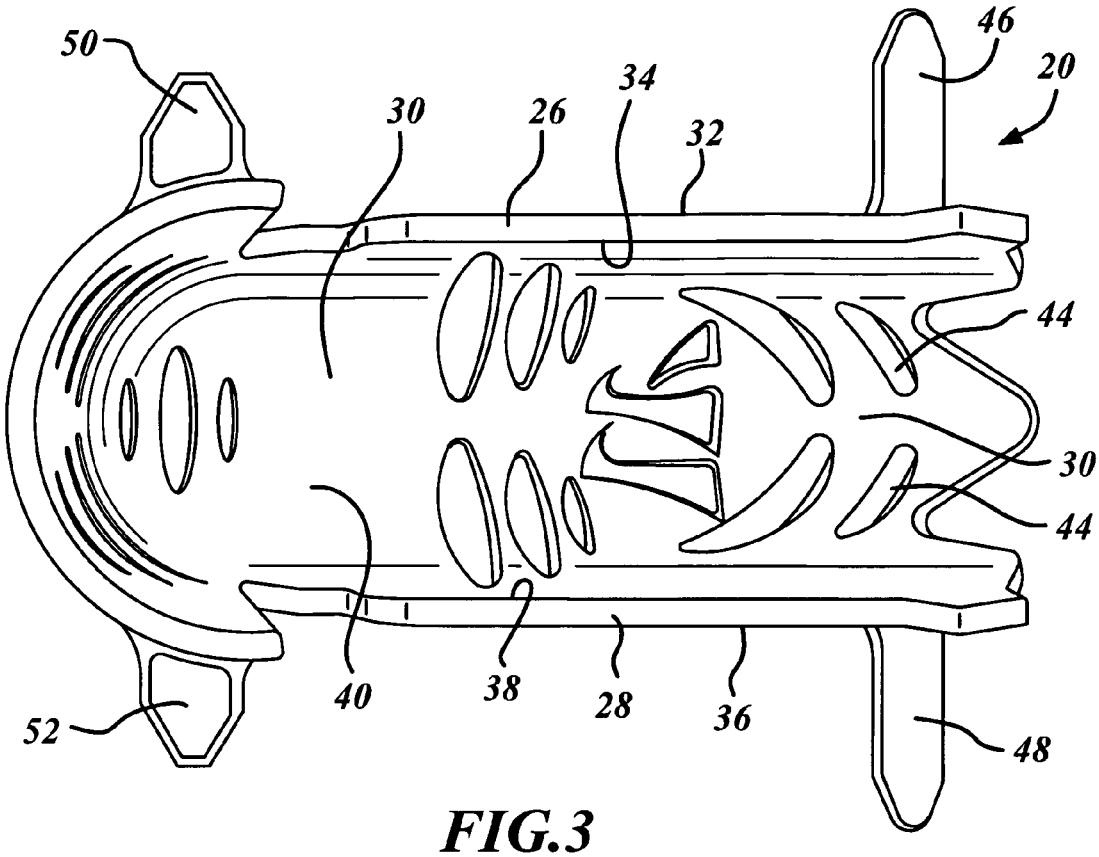
FIG. 3 illustrates a front view of one embodiment of the net shaper of the present invention.

Referring to FIG. 3, the net shaper has a first sidewall 26, a second sidewall 28, and a back wall 30. The first sidewall 26 has an exterior surface 32 and an interior surface 34. The second sidewall 28 has an exterior surface 36 and an interior surface 38. The first sidewall interior surface 34 is adjacent to the second sidewall interior surface 38.

The back wall 30 has an interior surface 40 and an exterior surface 42. The back wall 30 extends between the first sidewall 26 and the second sidewall 28 and is curved out and away from the first and second sidewalls 26, 28. More specifically, the back wall 30 extends between the interior surface 34 of the first sidewall and the interior surface 38 of the second sidewall. The first sidewall 26 and second sidewall 28 each has a generally arch shape and they are in parallel alignment with each other.

In FIGS. 1-6, the back wall 30 is shown having apertures 44, however, these are not a required feature of the present invention. In other words, the back wall may be solid containing no apertures.

There are at least two protrusions, one extending out from each sidewall. In the embodiment shown, there are four protrusions that extend out from the sidewalls 26, 28; a first protrusion 46; a second protrusion 48; a third protrusion 50; and a fourth protrusion 52. The protrusions 46, 48, 50, 52 help to keep the net shaper 20 in place within the lacrosse net 22. The protrusions interact with the frame 24 and the net 22 to keep the net shaper 20 in a fixed position within the net 22. There are two protrusions 46, 50 that extend out from the first sidewall exterior surface 32 and there are two protrusions 48, 52 that extend out from the second sidewall exterior surface 36. The first protrusion 46 and the third protrusion 50 extend out from the first sidewall 26. The second protrusion 48 and the fourth protrusion 52 extend out from the second sidewall 28. The first and second protrusions 46, 48 are the same length and are longer than the third and fourth protrusions 50, 52, which also have the same length.

FIGS. 1 and 2 illustrate the net shaper 20 positioned within the lacrosse head. The protrusions 46, 48, 50, 52 are positioned at the interface between the frame 24 and the net 22 to maintain the net shaper's position within the net 22. As illustrated in FIG. 1, the first and second protrusions 46, 48 are longer than the third and fourth protrusions 50, 52 due to their positions when positioned within the lacrosse head. The frame of the head is spaced wider apart where the first and second protrusions interact with the frame and net than where the third and fourth protrusions interact with the frame and the net.

The exterior surface 42 of the convex arch shaped back wall and the exterior surfaces of the first and second sidewalls are all positioned adjacent to the flexible net 22 and force the net to extend away from the frame 24 and conform to the back wall's convex shape. Therefore, when the net shaper is positioned within the lacrosse head, the net forms the generally nose-shaped contour of the net shaper and maintains this desired contour once the net-shaper is removed from the lacrosse head.

While the present invention has been described in what is presently considered to be its most practical and preferred embodiment or implementation, it is to be understood that the invention is not to be limited to the disclosed embodiment. On the contrary, the present invention is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A net shaper for use in combination with a lacrosse head, wherein the lacrosse head includes a lacrosse frame and a lacrosse net, said net shaper forms the lacrosse net to a particular contour, said net shaper comprising:

a first sidewall having an arch shape, said first sidewall having an exterior surface and an interior surface;

a second sidewall having an arch shape, said second sidewall being substantially parallel to the first sidewall, said second sidewall having an exterior surface and an interior surface;

a back wall joining said first sidewall and said second sidewall, said back wall curved outwardly away from said first and second sidewalls; and at least two protrusions extending outward from at least one of said first sidewall exterior surface and said second sidewall exterior surface a distance so that said at least two protrusions engage the frame and mount the net shaper in a contour forming, fixed position within the lacrosse net, wherein at least one of said at least two protrusions extends out from said first exterior surface, and another of the at least two protrusions extends out from said second sidewall surface.

2. The net shaper of claim 1 wherein there are at least four protrusions including a first protrusion, a second protrusion, a third protrusion, and a fourth protrusion.

3. The net shaper of claim 2 wherein said first protrusion and said third protrusion extend out from said first sidewall exterior surface and said second protrusion and said fourth protrusion extend out from said second sidewall exterior surface.

4. The net shaper of claim 3 wherein said first and second protrusions are the same length and said third and fourth protrusions are the same length.

5. The net shaper of claim 4 wherein said first and second protrusions are longer than said third and fourth protrusions.

6. The net shaper of claim 5 wherein when said component is positioned within a lacrosse head said first sidewall exterior surface, said back wall exterior surface and said second sidewall exterior surface are positioned adjacent to the net.

7. The net shaper of claim 6 wherein when said component is positioned within a lacrosse head said four protrusions are positioned between the frame and the net of the lacrosse head.

8. A lacrosse head net shaper for defining a contour of a lacrosse net, said lacrosse head net shaper comprising:

a lacrosse head frame;

a lacrosse head net attached to said lacrosse head frame;

a net shaper component having a contoured profile that fits within said lacrosse head net, said component having at least two protrusions that are positioned at an interface between said lacrosse head and said lacrosse net to maintain a position within said lacrosse head net, said at least two protrusions extending outward from said first sidewall exterior surface and said second sidewall exterior surface a distance so that said at least two protrisions engage the frame and mount the net shaper in a contour forming fixed position within the lacrosse net, wherein said at least two protrusions include a first sidewall, a second sidewall that is opposite said first sidewall, and a back wall extending between said first sidewall, and second sidewall.

wherein said at least two protrusions include a first protrusion, a second protrusion, a third protrusion and a fourth protrusion.

wherein said first protrusion and said third protrusion extend out from said first sidewall, and said second protrusion and said fourth protrusion extend out from said sidewall.

9. The lacrosse head net shaper of claim 8 wherein said first and second protrusions have a first length dimension and said third and fourth protrusions have a second length dimension.

10. The lacross head net shaper of claim 9 wherein said first length dimensions is grater than said second length dimension.

11. The net shaper of claim 3 wherein the first and second protrusions are seperated from one another a first distance, and adapted to engage the frame in at least two different locations on a first side of the lacrosse frame.

12. The net shaper of claim 11 wherein the third and fourth protrusions are seperated from one another a second distance, and adapted to engage the frame in another at least two different locations on a second side of the lacrosse frame.

13. A net shaper for use in combination with a lacrosse head net for forming the net to a particular contour, said net shaper comprising;

a first side exterior surface;

a second side exterior surface opposite the first side exterior surface, the first side exterior surface arcuately transitioning to and joined with the second side exterior surface;

an upper exterior surface and a lower exterior surface, the upper exterior surface arcuately transitioning and joined with the lower exterior surface as well as the first side exterior surface and the second side exterior surface to form a substantially continuous curved contour corresponding to a desired pocket profile; and a first tab extending from the first side surface, adjacent the upper exterior surface, a second tab extending from the first side exterior surface adjacent the lower exterior surface a third tab extending from a second side exterior surface, wherein the first and second tabs are seperated from one another by a pre-selected distance, the first, second and third tabs adapted to engage the lower portion of the frame in at least three locations on the frame to press a contour into the lacrosse net with the net shaper, thereby providing a desired pocket profile with the net shaper.

14. The net shaper of claim 13 comprising a fourth tab extending from the second side exterior surface adjacent the upper exterior surface, the third tab being adjacent the lower exterior surface.

* * * * *

UNITED STATES PATENT AND TRADEMARK OFFICE

CERTIFICATE OF CORRECTION

PATENT NO. : 7,445,571 B2
APPLICATION NO. : 11/439708
DATED : November 4, 2008
INVENTOR(S) : Matthew Winningham It is certified that error appears in the above-identified patent and that said Letters Patent is hereby corrected as shown below:

Column 4, Claim 8, Line 27:
"protrisions" should be --protrusions--

Column 4, Claim 8, Line 33:
the period "." should be a comma --,--

Column 4, Claim 8, Line 36:
the period "." should be a comma --,--

Column 4, Claim 10, Line 45:
"lacross" should be --lacrosse--

Column 4, Claim 10, Line 46:
"dimensions" should be --dimension--

Column 4, Claim 10, Line 46:
"grater" should be --greater--

Column 5, Claim 13, Line 6:
after the first occurrence of "surface" should be a comma --surface,--

Signed and Sealed this

Twenty-fourth Day of March, 2009

JOHN DOLL
*Acting Director of the United States Patent and Trademark Office*